United States Patent [19]

Hayes et al.

[11] Patent Number: 4,819,537

[45] Date of Patent: Apr. 11, 1989

[54] HELMHOLTZ RESONANT SIMULATOR

[76] Inventors: Joseph F. Hayes, 64 Great Buckingham St., Redfern, N.S.W.; Warwick H. Holmes, 14 Gale St., Woolwich, N.S.W., both of Australia

[21] Appl. No.: 54,069

[22] Filed: May 19, 1987

Related U.S. Application Data

[63] Continuation of Ser. No. 764,832, Aug. 9, 1985, abandoned.

[30] Foreign Application Priority Data

Aug. 10, 1984 [AU] Australia ..... PG6507

[51] Int. Cl.[4] ..... G10H 1/12; G10H 3/18

[52] U.S. Cl. ..... 84/1.11; 84/1.16; 84/DIG. 9

[58] Field of Search ..... 84/1.04, 1.06, 1.11, 84/1.12, 1.14–1.16, DIG. 9, DIG. 24, 1.19–1.23

[56] References Cited

U.S. PATENT DOCUMENTS

| | | | |
|---|---|---|---|
| 3,454,702 | 7/1969 | Elbrecht et al. . | |
| 3,493,669 | 2/1970 | Elbrecht et al. | 84/1.16 |
| 3,591,700 | 7/1971 | Neubauer et al. . | |
| 3,663,735 | 5/1972 | Evans | 84/1.16 X |
| 3,688,010 | 8/1972 | Freeman . | |
| 4,211,893 | 7/1980 | Smith . | |
| 4,251,687 | 2/1981 | Deutsch . | |
| 4,306,480 | 12/1981 | Eventoff et al. . | |
| 4,379,212 | 4/1983 | Martin . | |
| 4,382,398 | 5/1983 | O'Neill | 84/DIG. 9 |
| 4,501,186 | 2/1985 | Ikuma | 84/1.16 |

FOREIGN PATENT DOCUMENTS 2906987 2/1979 Fed. Rep. of Germany .

*Primary Examiner*—Stanley J. Witkowski

*Attorney, Agent, or Firm*—Limbach, Limbach & Sutton

[57] ABSTRACT

For electronically reproducing the total sound produced by a musical instrument, the musical instrument comprises a plurality of components each of which produces one aspect of the total sound, an electronic acoustic reproduction system comprises vibration transducer means mounted on the instrument for receiving the one aspect of the total sound from one of the components and transforming the one aspect to an electrical signal, and electronic filter means for processing the electrical signal to produce a total electrical signal representative of the total sound of the musical instrument.

4 Claims, 4 Drawing Sheets

HELMHOLTZ RESONANT SIMULATOR

This is a continuation of co-pending application Ser. No. 764,832 filed on Aug. 9, 1985 and now abandoned.

DESCRIPTION

1. Technical Field

This invention relates to musical instruments, and more particularly, to electrical musical instruments.

2. Background Art

Acoustic reproduction using electrical equipment is well known in the art. One type of musical instrument that employs electrical equipment is stringed instruments such as guitars, banjos or violins. For example, a stringed instrument such as a guitar generally includes a hollow air chamber, a sound board, and a hole or system for generating the resonance of the air chamber of the guitar. Such an acoustic cavity is also referred to as a Helmholtz resonator. The true sound produced by the guitar includes both sound emanating from the sound hole and sound emanating from the sound board. The sound hole is frequently referred to as an air hole or a rose, and the sound board is frequently referred to as a sound plate. Since the vibrations of the sound board occur at various frequencies, it is possible to accurately determine the mode of the sound board vibrations. These sound board vibrations, generally occuring at the vicinity of the Helmholtz air resonance and the first resonance mode of the sound board, are well known. In current acoustic reproduction technology, mechanical vibration transducers are used to convert the sound board vibrations into electrical signals that are suitable for sound reinforcement or amplification and/or recording. Such transducers or pick-ups may comprise piezoelectric devices, strain gauges, or accelerometers. In addition, these pick-ups are usually mounted on the sound board, adjacent to the bridge, as best shown in FIG. 1.

This arrangement, however, fails to transduce the complete acoustic sound of the guitar because the sound board vibrations are not representative of the total sound produced by the guitar. In addition to the sound board vibrations, the total sound produced by the guitar also includes the sound that emanated from the sound hole. The sound emanating from the sound hole, generally in the low to mid frequency range, is greatly accentuated by the hollow body which acts as a resonator. This accentuated sound propagating through the air cannot be picked up by mechanical transducers which are mounted on the sound board. This incapacity to receive airborne vibration is further aggravated by the fact that the sound emanating from the sound hole and the sound emanating from the sound board are not in phase when they are below the Helmholtz resonance. Since the mechanical transducers are capable of only picking up the sound board vibrations, the reproduced sound lacks the natural acoustic balance of the guitar. To alleviate this deficiency, prior art techniques employ a microphone in addition to the usual transducers, as best shown in FIG. 2. The sound hole resonance received by the microphone and the sound board vibrations received by the transducers are either combined or transmitted separately to the listener. This is an impractical solution in that the guitar must be played near the microphone, restricting the movement of the guitar player. In addition, the microphone has a propensity for picking up not only feedback that radiates from the sound board but also feedback in the nature of acoustic standing waves which are propagating between the sound board and the microphone.

Examples of prior art electrical musical instruments include

Elbrecht et al.: U.S. Pat. No. 3,454,702
Neubauer et al.: U.S. Pat. No. 3,591,700
Freeman: U.S. Pat. No. 3,688,010
Smith: U.S. Pat. No. 4,211,893
Deutsch: U.S. Pat. No. 4,251,687
Eventoff et al.: U.S. Pat. No. 4,306,480
Martin: U.S. Pat. No. 4,379,212
Nourney: West Germany DE No. 2,906987.

DISCLOSURE OF THE INVENTION

In view of the deficiencies in the prior art, it is a major object of the present invention to provide an electrical circuit for simulating the Helmholtz resonance of an instrument such that the total sound of the instrument is transduced by a single device.

It is another object of the present to provide an electrical circuit for simulating the Helmholtz resonance of an instrument such that it alleviates and minimizes the above-mentioned disadvantages.

In order to accomplish the above and still further objects, the present invention provides an electronic acoustic reproduction system for electronically reproducing the total sound produced by a musical instrument, the musical instrument comprises a plurality of components each of which produces one aspect of the total sound. The electronic acoustic reproduction system comprises vibration transducer means mounted on the instrument for receiving the one aspect of the total sound from one of the components and transforming the one aspect to an electrical signal, and electronic filter means for processing the electrical signal to produce a total electrical signal representative of the total sound of the musical instrument.

Other objects, features, and advantages of the present invention will appear from the following detailed description of the best mode of a preferred embodiment, taken together with the accompanying drawings.

BEST MODE FOR CARRYING OUT THE INVENTION

Figure 1:
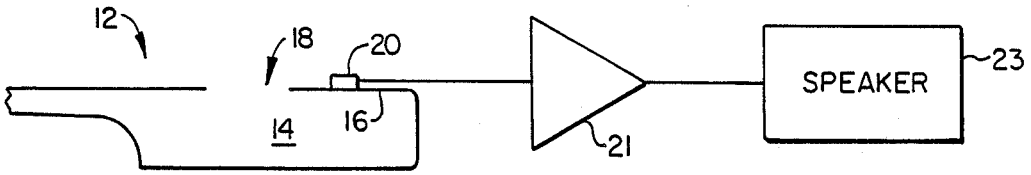
FIG. 1. (PRIOR ART)
FIG. 1 is a simplified illustration of a prior art acoustic reproduction technique.

Referring to FIG. 1, there is shown a prior art acoustic reproduction technique in which a guitar 12 includes a hollow air chamber 14, a sound board 16, a sound hole 18, a mechanical vibration transducer 20, an amplifier 21, and a speaker 23. Mechanical vibration transducer 20 is mounted on sound board 16. Since transducer 20 is incapable of receiving the sound produced by sound hole 18, which is generally in the low/mid frequency range, an incomplete sound for guitar 12 is reproduced by the technique.

Figure 2:
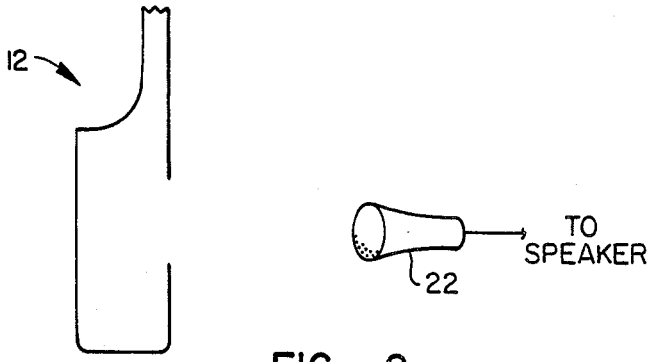
FIG. 2. (PRIOR ART)
FIG. 2 is a simplified illustration of another prior art acoustic reproduction technique.

To alleviate this disadvantage, the alternative technique of FIG. 2 is employed. The alternative technique utilizes a microphone 22 that is capable of receiving the sound hole resonance. The alternative technique also includes deficiencies one of which being the required placement of microphone 22 near guitar 12, thereby restricting the movement of the player. In addition, feedback disturbances are generally produced by this technique.

As for the general principles of acoustic reproduction, it is well known that the internal surface of sound board 16 of guitar 12 is capable of compressing hollow air chamber 14 such that vibrations from sound hole 18 are produced. It, however, is not previously known that it is possible to recreate the sound hole vibrations or radiation from one or more mechanical transducers that have been placed on sound board 16.

In general, the transfer function that relates the sound board radiation or signal to the sound hole radiation or signal is as follows:

$$\frac{\text{SOUND HOLE RADIATION}}{\text{SOUND BOARD RADIATION}} = \frac{-\omega_h^2}{(\omega_h^2 - \omega^2) + i\omega a}$$

where $\omega$=angular frequency variable (rad/sec)

$\omega_h$=angular frequency of Helmholtz resonance (rad/sec)

i=complex operator $\sqrt{-1}$ a=variable.

The negative sign in this equation represents the fact that the air within chamber 14 is being alternately compressed and expanded as sound board 16 vibrates. This relationship illustrates the fact that the sound hole radiation can be obtained electrically by using the sound board vibrations. The radiation from sound board 16 and sound hole 18 are additive in the near field of guitar 12 to give one acoustic signal. Thus, the sound hole signal obtained in this fashion can be added to the sound board signal directly transduced by transducer 20 to give the total acoustic signal from guitar 12. The total acoustic signal is expressed as follows:

$$\text{TOTAL ACOUSTIC SIGNAL} = \left\{ \text{sound board signal} + \frac{\text{(sound hole signal)}}{\text{(sound board signal)}} \times \text{sound board signal} \right\}$$

$$\frac{\text{TOTAL ACOUSTIC SIGNAL}}{\text{SOUND BOARD SIGNAL}} = 1 + \frac{-\omega_h^2}{(\omega_h^2 - \omega^2) + i\omega a}$$

$$\frac{\text{TOTAL ACOUSTIC SIGNAL}}{\text{SOUND BOARD SIGNAL}} = \frac{i\omega\,(i\omega + a)}{-\omega^2 + i\omega a + \omega_h^2}.$$

Figure 3:
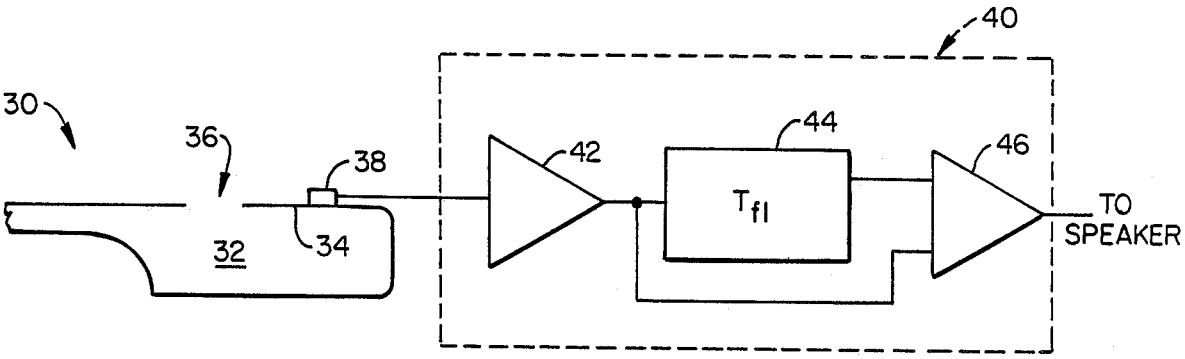
FIG. 3 is a simplified block diagram of the Helmholtz resonance simulator of the present invention.

As best shown in FIG. 3, the present invention utilizes the above-illustrated relationships to obtain the total acoustic signal. In the preferred embodiment, a guitar 30 includes a hollow chamber 32, a sound board 34, and a sound hole 36. The present invention comprises a vibration transducer 38, a circuit 40, and a speaker, not shown. Transducer 38 is electrically connected to circuit 40. Circuit 40, generally referred to as a filter, comprises a preamplifier 42, a transfer function block 44, and a summing amplifier 46. Filter 40 is preferably a second order parametric filter that is capable of processing the vibrations from sound board 34 to reproduce a signal that represents the total acoustic signal of guitar 30. Filter 40 is fed with the signal derived from the direct mechanical vibrations of sound board 34. Circuit 40, therefore, is capable of simulating the Helmholtz resonance of guitar 30.

When the characteristics of guitar 30 are known, the characteristics of filter 40 may be set or preadjusted for guitar 30. Alternatively, the characteristics of filter 40 may be varied and adjusted to match the characteristics of guitar 30. Generally, only two parameters of filter 40 need to be varied; the resonant frequency ($f_o$) of filter 40 and the Q factor of the resonance. Filter 40, generally an active filter, may function as either a high pass or low pass filter. More particularly, the input of preamplifier 42 may be derived from one or more transducers 38 which are placed on sound board 34. Preamplifier 42 also functions as an impedance matching network. Although a preamplifier need not be employed, the signal forwarded to filter 40 needs to be provided with a low impedance source in order to ensure that filter 40 is not loaded.

The parametric requirements for filter 40 of the present invention are varied depending on the characteristics of guitar 30. When sound board or plate 34 is represented as a damped mass/spring resonant system and sound hole 36 as an air piston, a simple model of the volume velocities of both sound board 34 and sound hole 36 for a low frequency guitar may be represented by the following:

$$U_p = i\omega(F/M_p)\,\{[(\omega_h^2 - \omega^2) + i\omega\gamma_a]/D\}$$

$$U_a = -i\omega(F/M_p)\,(A/S)\,(\omega_h^2/D)$$

where $U_p$=volume velocity of the sound board $U_a$=volume velocity of the sound hole F=driving force of the strings $M_p$=mass of the sound board D=denominator A=area of the vibrating sound board S=area of the sound hole $\gamma_a$=constant due to the instrument properties, e.g., air.

The comparison of these equations produces the transfer function for the sound hole radiation as affected by the excitation force of sound board 34. The transfer function equation is as follows:

$$U_p/U_a = \frac{-(A/S)(\omega_h^2)}{(\omega_h^2 - \omega^2) + i\omega\gamma_a} = \frac{(-A/S)\,\omega_h^2}{(\omega_h^2 - \omega^2) + i\omega\dfrac{R_a}{M_a}},$$

where $R_a$=resistance of the sound hole $M_a$=mass of the sound hole.

In addition, the sound pressure due to a point source radiation is as follows:

$$P = -i\omega\rho U/4\pi R,$$

where U=total volume velocity of the source. Thus, $$U=AU_p+SU_a.$$

Since a signal that is representative of the point source volume velocity equivalent displacement is required, $\xi$ and $U_p=\omega\xi$, $$\xi=A\xi_p+S\xi_a,$$

or $$\xi/A=\xi_p+S/A\ \xi_a,$$

where $\xi_p$=linear excursion of the sound board $\xi_a$=linear excursion of the sound hole.

In addition, $$\frac{\text{TOTAL SIGNAL}}{\text{SCALE FACTOR}} = \xi_p + S/A \times \frac{-A/S\ \omega_h^2}{(\omega_h^2-\omega^2)+i\omega\frac{R_a}{M_a}} \times \xi_p$$

$$= \xi_p - \frac{\omega_h^2}{(\omega_h^2-\omega^2)+i\omega\frac{R_a}{M_a}} \times \xi_p$$

$$\text{Since } \frac{U_a}{U_p} = \frac{\xi_a}{\xi_p},$$

the total filtering action upon a signal representative of sound board excursion $\xi_p$ is $$F(s) = 1 - \frac{\omega_h^2}{(\omega_h^2-\omega^2)+i\omega\frac{R_a}{M_a}}.$$

This equation can be obtained with a split signal path of $\xi_p$ one path of which is inverted and filter by $$\frac{\omega_h^2}{(\omega_h^2-\omega^2)+i\omega\frac{R_a}{M_a}}.$$

This results in block 44 of filter 40 being equaled to the above equation with a negative sign, $$T_{f1} = \frac{-\omega_h^2}{(\omega_h^2-\omega^2)+i\omega\frac{R_a}{M_a}}.$$

The parametric requirement for block 44 are as follows. If the resonant frequency ($f_o$) of double bass strings is at approximately 41 Hz, then the $f_{omin}$ is approximately 40 Hz. If the $f_o$ of the violin is approximately 295 Hz, then the $f_{omax}$ is approximately 400 Hz.

The parametric control of the gain of filter 40 should be in the range of approximately 0.5 to 35 dB in order to effectively cover all instruments such as violins and banjos.

Figure 4:
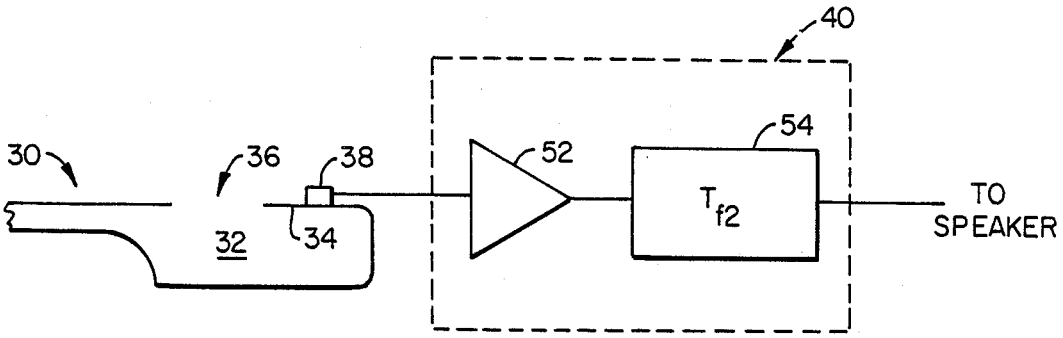
FIG. 4 is an alternative block diagram of the simulator of FIG. 3.

In the alternative technique of FIG. 4, filter 40 comprises a preamplifier 52 and a transfer function block 54. The input of preamplifier 52 is connected to transducer 38 and the output is connected to block 54. The output of block 54 is connected to a speaker, not shown. The transfer function of filter 40 in the alternative embodiment is as follows:

$$T_{f2} = \frac{s(s+a)}{(s^2+sa+\omega_h^2)},$$

where a=variable s=Laplace transform variable.

Parametric control in this instance is obtained by varying "a" and $\omega_h$.

Figure 5:
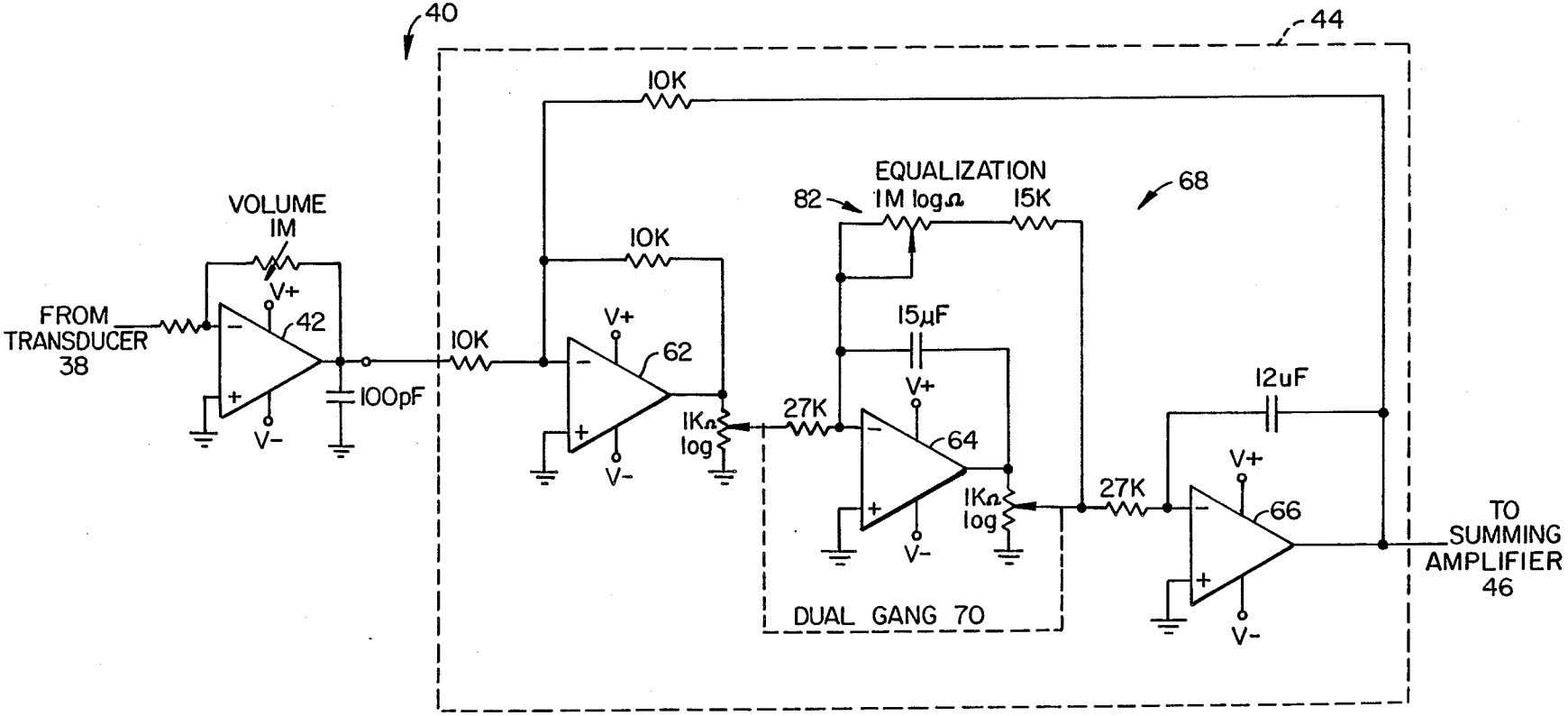
FIG. 5 is a partial schematic view of the simulator of FIG. 3.
Figure 6:
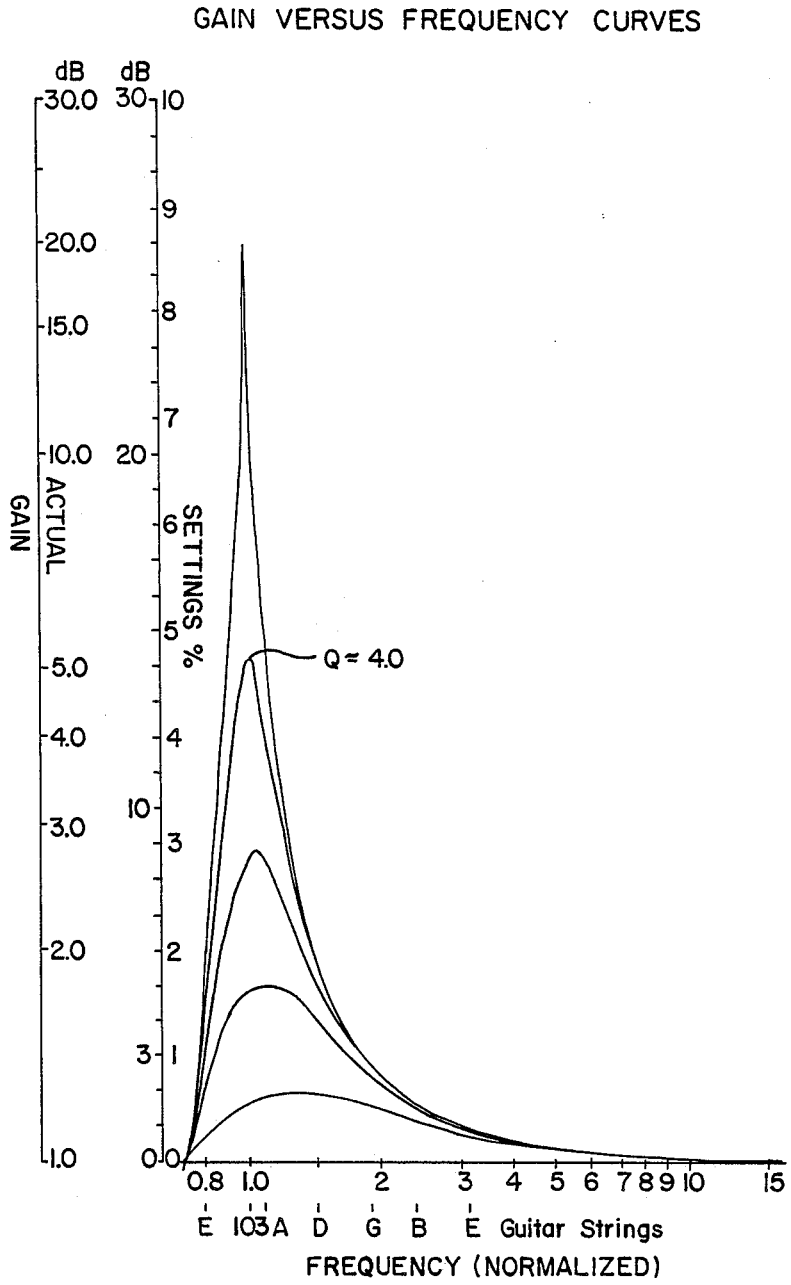
FIGS. 6 and 7 are transfer function graphs of the simulator of FIG. 5.
Figure 7:
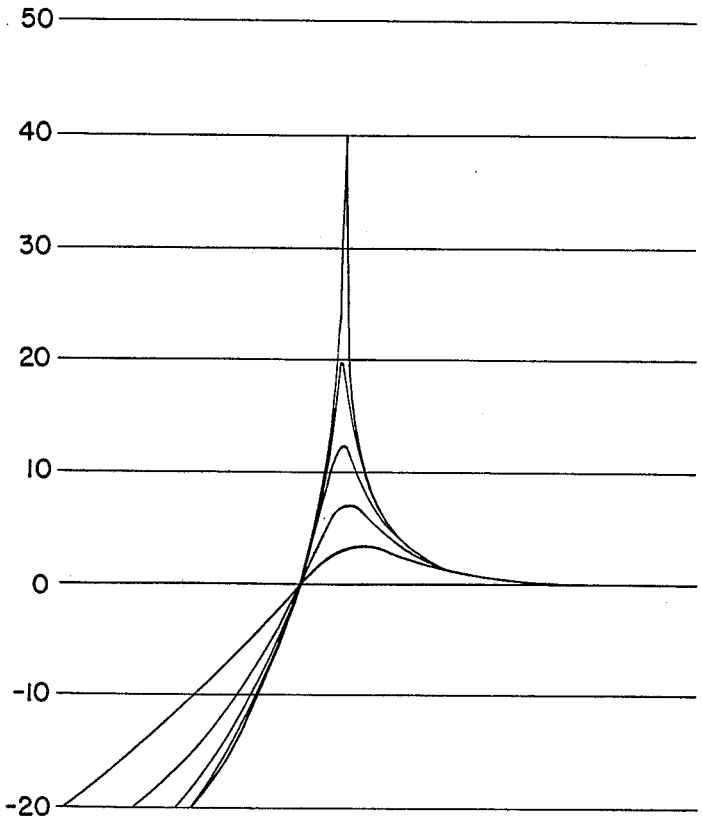

Referring to FIG. 5, there is shown a partial schematic representation of the simulator of FIG. 3. Preamplifier 42 in this schematic is an operational amplifier. Block 44 in this schematic comprises operational amplifier 62, 64 and 66, which generate the required transfer function. Moreover, ganged potentiometers 70 are provided to enable the alteration of the resonant frequency of block 44 without affecting the gain of filter 40. If, however, it is unimportant that the gain remain unchanged when the resonant frequency is altered, potentiometers 70 need not be ganged. Further, potentiometers 82 may be employed to alter the gain of block 44. When potentiometers 70 and 82 are varied, the resultant transfer functions of block 44, or in turn filter 40, are illustrated in FIGS. 6 and 7, respectively. For example, FIG. 6 illustrates a plurality of gain versus frequency curves. The x-axis represents normalized, logarithmic frequencies in relation to the guitar strings. The y-axis represents actual gain and gain generated by filter 40. At the normalized frequency of "1," the gains of block 44 are at their maximum for various settings of potentiometers 70 and 82. In light of the fact that gain =Q+1, if the actual gain is approximately 5.0, the Q factor for a particular curve is approximately 4.0. In addition, the possible gains for a particular guitar string, e.g., "D," are readily determined. FIG. 7 illustrates the negative gain portions of the curves of FIG. 6.

It will be apparent to those skilled in the art that various modifications may be made within the spirit of the invention and the scope of the appended claims.

We claim:

1. For electronically reproducing the total sound of a stringed musical instrument, the stringed musical instrument having a hollow air chamber, a sound board and a sound hole, wherein the sound board generates sound board vibrations and the sound hole generates sound hole vibrations such that the sound board vibrations and the sound hole vibrations combine to form the total sound, and further wherein the sound hole includes a mass of air that creates air resistance, an electronic acoustic reproduction system comprising vibration transducer means mounted on the sound board for receiving only the sound board vibrations and transforming the sound board vibrations into sound board electrical signals; and electronic filter means for processing the sound board electrical signals and generating sound hole electrical signals representative of the sound hole vibrations of the stringed musical instrument, wherein said electronic filter means has a transfer function characteristic of $$T_{[f1]}(i\omega) = \frac{-\omega_h^2}{\omega_h^2-\omega^2+i\omega\frac{R_a}{M_a}},$$

where $\omega$=angular frequency variable $\omega_h$=angular frequency of the resonance of the air chamber $R_a$=air resistance of the mass of air in the sound hole $M_a$=mass of vibrating air in the sound hole $i=\sqrt{-1}$ to produce said sound hole electrical signals, said filter means further having means for combining said sound board electrical signals and said sound hole electrical signals to produce a total electrical signal representative of the total sound.

2. For electronically reproducing the total sound of a stringed musical instrument, the stringed musical instrument having a hollow air chamber, a sound board and a sound hole, wherein the sound board generates sound board vibrations and the sound hole generates sound hole vibrations such that the sound board vibrations and the sound hole vibrations combine to form the total sound, and further wherein the sound hole includes a mass of air that creates air resistance, an electronic acoustic reproduction system comprising vibration transducer means mounted on the sound board for receiving only the sound board vibrations and transforming the sound board vibrations into sound board electrical signals; and electronic filter means for processing the sound board electrical signals and generating a total electrical signal representative of the total sound of the stringed musical instrument, wherein said electronic filter means has a transfer function characteristic of $$T(i\omega) = \frac{-\omega^2 + i\omega\,(R_a/M_a)}{\omega_h^2 - \omega^2 + i\omega\,\frac{R_a}{M_a}},$$

where $\omega$=angular frequency variable $\omega_h$=angular frequency of the resonance of the air chamber $R_a$=air resistance of the mass of air in the sound hole $M_a$=mass of vibrating air in the sound hole $i=\sqrt{-1}$.

3. For electronically reproducing the total sound of a stringed musical instrument, the stringed musical instrument having a hollow air chamber, a sound board and a sound hole, wherein the sound board generates sound board vibrations and the sound hole generates sound hole vibrations such that the sound board vibrations and the sound hole vibrations combine to form the total sound, and further wherein the sound hole includes a mass of air that creates air resistance, an electronic acoustic reproduction system comprising vibration transducer means mounted on the sound board for receiving only the sound board vibrations and transforming the sound board vibrations into sound board electrical signals; and electronic filter means for processing the sound board electrical signals and generating sound hole electrical signals representative of the sound hole vibrations of the stringed musical instrument, wherein said electronic filter means has a transfer function characteristic of $$T(s) = \frac{-\omega_h^2}{s^2 + s\,\frac{R_a}{M_a} + \omega_h^2},$$

where s=Laplace transform variable $\omega_h$=angular frequency of the resonance of the air chamber $R_a$=air resistance of the mass of air in the sound hole $M_a$=mass of vibrating air in the sound hole.

to produce said sound hole electrical signals, said filter means further having means for combining said sound board electrical signals and said sound hole electrical signals to produce a total electrical signal representative of the total sound.

4. For electronically reproducing the total sound of a stringed musical instrument, the stringed musical instrument having a hollow air chamber, a sound board and a sound hole, wherein the sound board generates sound board vibrations and the sound hole generates sound hole vibrations such that the sound board vibrations and the sound hole vibrations combine to form the total sound, and further wherein the sound hole includes a mass of air that creates air resistance, an electronic acoustic reroduction system comprising vibration transducer means mounted on the sound board for receiving only the sound board vibrations and transforming the sound board vibrations into sound board electrical signals; and electronic filter means for processing the sound board electrical signals and generating a total electrical signal representative of the total sound of the stringed musical instrument, wherein said electronic filter means has a transfer function characteristic of $$T(s) = \frac{s\,(s + R_a/M_a)}{s^2 + s\,\frac{R_a}{M_a} + \omega_h^2},$$

where s=Laplace transform variable $\omega_h$=angular frequency of the resonance of the air chamber $R_a$=air resistance of the mass of air in the sound hole $M_a$=mass of vibrating air in the sound hole.

* * * * *